US006148783A

United States Patent [19]

Hesher et al.

[11] Patent Number: 6,148,783

[45] Date of Patent: Nov. 21, 2000

[54] VALVE SEAL BODY INCLUDING ENCAPSULATED METAL SPRING SEAT AND METHOD FOR MAKING THE SAME

[75] Inventors: Eric Hesher, Avilla; Troy McArthy, Kendallville, both of Ind.

[73] Assignee: Dana Corporation, Toledo, Ohio

[21] Appl. No.: 09/332,324

[22] Filed: Jun. 14, 1999

[51] Int. Cl.[7] ..... F01L 3/08

[52] U.S. Cl. ..... 123/188.6

[58] Field of Search ..... 123/188.6, 188.12, 123/190.17, 188.11

[56] References Cited

U.S. PATENT DOCUMENTS

| | | | |
|---|---|---|---|
| 897,023 | 8/1908 | Schaap . | |
| 3,171,659 | 3/1965 | Anderson et al. . | |
| 3,235,271 | 2/1966 | Johnson et al. . | |
| 3,326,562 | 6/1967 | Deuring . | |
| 3,599,992 | 8/1971 | Kammeraad | 123/188.6 |
| 3,910,586 | 10/1975 | Todaro | 123/188.6 |
| 4,834,037 | 5/1989 | Lafever . | |
| 5,110,142 | 5/1992 | Szott | 123/188.6 |

*Primary Examiner*—Willis R. Wolfe
*Assistant Examiner*—Hyder Ali
*Attorney, Agent, or Firm*—Rader, Fishman & Grauer PLLC

[57] ABSTRACT

An improved integral valve seal body suitable for an internal combustion engine and a method for making the valve seal body is disclosed. The valve seal body is comprised of a valve seal retainer including a cylindrical body and a metal spring seat. The valve seal retainer defines an inner cylindrical passageway and includes a radially extending flange. The metal spring seat, which may be comprised of a corrugated metal washer, is substantially or entirely encapsulated within the radially extending flange of the valve seal retainer body.

20 Claims, 1 Drawing Sheet

VALVE SEAL BODY INCLUDING ENCAPSULATED METAL SPRING SEAT AND METHOD FOR MAKING THE SAME

FIELD THE INVENTION

The present invention relates to valve seal bodies for a combustion engine, and more particularly to an improved plastic valve seal body having an encapsulated metal spring seat and a method for making the encapsulated seat.

BACKGROUND OF THE INVENTION

In the heavy-duty engine market a number of changes are being made to comply with recent and prospective emissions standards. As the construction of the engine changes, engine designers must nevertheless maintain a robust engine design with a sufficient level of dependability. One of the more prominent changes being implemented is the increase of the power rating of the engine. To achieve higher horsepower, many engine designs require a higher boost. Increasing the required amount of boost, in turn, puts a greater demand on the valve seal. Many of these engines are increasing their boost by up to 50–60 psig, which is a far greater pressure than most bonded valve seals can handle while being properly retained on a valve guide. For such cases, an integral valve seal with a metal retainer is normally recommended.

In order to put an integral valve seal on a valve, the valve seal must cover the valve guide that protrudes from the deck of the cylinder head. However, some such valve guides exceed 50.8 mm. (2.0 in.) in height, a height at which metal stampings become very difficult to produce. Moreover, engine designers are reluctant to reduce the height of the valve guide to address the limitations of the seals.

Further, valve seal designs that attempt to address the inherent problems must meet a number of rigorous requirements to function properly. Unitary molded plastic valve seals are known to the industry. However, conventional unitary molded plastic sleeves are not generally suited to withstand the heat and high pressures of a heavy-duty valve spring opening and closing repeatedly over the course of the intended life of the cylinder head.

Likewise, the prior art discloses the use of rigid reinforcing members at various portions of the valve stem seals. However, such reinforcements provide their own inherent limitations. For instance, reinforcements are not always formed integrally with the valve seal; can be difficult to install; and often do not fully provide the desired physical/mechanical functions, for example, by acting as a spring seat between the valve seal retainer body, valve spring, and engine head.

Therefore, a need exists in the industry for an improved plastic valve seal that can be incorporated into a combustion engine using conventional assembly techniques and handle increased environmental heat and pressure, yet still provide a desired level of performance throughout the intended life of the part.

SUMMARY OF THE INVENTION

The present invention relates to an integral valve seal body suitable for use in connection with an internal combustion engine. The valve seal body is comprised of a valve seal retainer including a cylindrical body and a metal spring seat. The valve seal retainer defines an inner cylindrical passageway and includes a radially extending flange. The metal spring seat, which may be comprised of a corrugated metal washer, is substantially or entirely encapsulated within the radially extending flange of the valve seal retainer body. As a further aspect of the invention, a method for manufacturing such a valve seal body is also disclosed.

Recognizing the problems and difficulties associated with the use of valve seal bodies in heavy-duty, high temperature and high pressure environments, such as combustion engines, a valve seal body constructed in accordance with the principles of the present invention can provide several advantages over those previously available. Such advantages are generally realized through the substantial encapsulation of a metal spring seat within a valve seal retainer, and more preferably, a radially extending flange thereof.

An important aspect of the present invention is its ability to incorporate the functional benefits of a metal spring seat and secure positioning of the seat with respect to the valve seal body and mating parts in a cost-effective manner without unduly complicating the assembly process. Because the improved valve seal body of the present invention can be constructed in traditional, as well as non-traditional configurations, a further feature of the present invention is that the valve seal body, including the encapsulated metal spring seat, can be installed as a single unit using conventional assembly techniques.

The inclusion of a metal spring seat, such as a corrugated washer, within the structure of a valve seal body provides a number of other design-related advantages, including the ability to improve the physical and mechanical functioning of the valve seal body. For example, the metal spring seat can be formed from materials that provide improved protection for the remainder of the valve seal body, which is most typically comprised of a plastic material. Likewise, the metal spring seat can be configured for improved support and firmly secured within the valve seal body so as to provide improved load bearing and load dispersing capabilities. Such capabilities can prove to be particularly valuable in heavy-duty, high temperature and high-pressure environments.

Other and further advantages and novel features of the invention will become apparent from the following detailed description, taken in connection with the accompanying drawings, wherein, by way of illustration and example, embodiments of the present invention are disclosed.

BRIEF DESCRIPTION OF THE DRAWINGS

The present invention will be more readily understandable from consideration of the accompanying drawings, wherein.

DETAILED DESCRIPTION OF PREFERRED EMBODIMENTS

Figure 1:
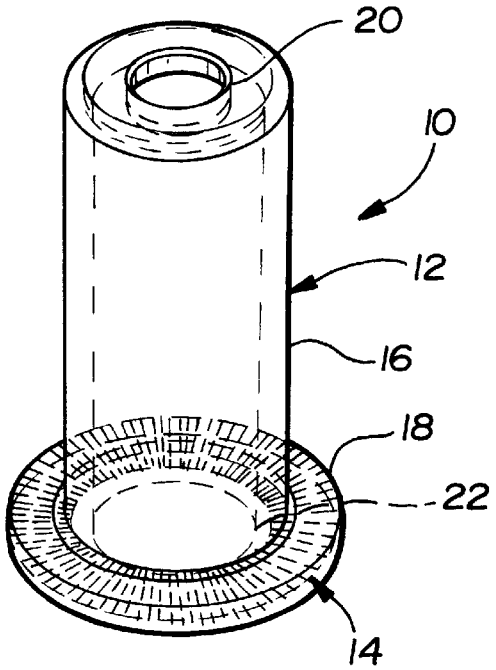
FIG. 1 is a perspective view of a valve seal body formed in accordance with the principles of the present invention.

Referring to FIG. 1, a preferred embodiment of a valve seal body 10 is illustrated. The valve seal body 10 is ordinarily of a top hat configuration and includes a valve seal retainer 12 and a metal spring seat 14.

The valve seal retainer 12 includes a cylindrical body 16, which defines an inner cylindrical passageway, and a radially outwardly extending flange 18. The valve seal retainer 12 typically has a reduced diameter region 20 adjacent one end and an enlarged diameter region 22 adjacent the radially extending flange 18 at the opposite end. A valve spring (not illustrated) seats against the upper surface of the flange 18 and maintains the valve seal body 10 in position on the engine head. Preferably, the diameter of the cylinder body 16 will be approximately one-half the diameter of the flange 18. The valve seal retainer 12 is preferably comprised of a heat-resilient plastic material, such as high temperature polyester elastomer having block copolymers of short chain diol terephthalate and long chain copolymers. However, it is to be noted that similar polyester elastomer materials that have good dimensional stability and service durability at relatively elevated temperatures and pressures such as those encountered in the environment of a combustion engine may also be utilized.

In accordance with the present invention, the metal spring seat 14 is substantially encapsulated within the valve seal retainer 12. The spring seat 14 is made of metal to meet the needs of the intended environment, wherein the seat 14 should be capable of withstanding the higher temperatures and pressures associated with a combustion engine and the severe conditions associated with heavy-duty valve spring action. While the metal spring seat 14 may be comprised of hardened steel, the seat can also be fabricated from any known metal, or a combination of metals and other materials, provided that the metal or combination thereof can adequately meet the necessary requirements of the intended environment.

Figure 2:
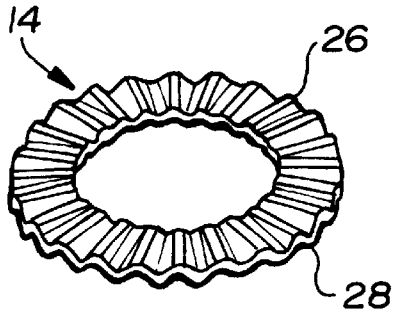
FIG. 2 is a perspective view of a preferred embodiment of a spring seat.

In a preferred construction, the metal spring seat 14 includes a corrugated washer. An example of such a preferred metal spring seat 14 is depicted in FIG. 2. As illustrated, the spring seat 14 includes a plurality of alternating top and bottom portions, respectively designated by the numerals 26 and 28. A corrugated design, such as the one disclosed, is often preferred because the plastic material is dispersed between folds or "pockets" of alternating top and bottom portions 26,28. This type of folded construction provides a structure with increased surface area for improved contact between the spring seat 14 and the plastic material so as to better retain the spring seat 14 in a desired position. Moreover, the configuration of the metal spring seat 14 can be designed to provide improved loadbearing and load-dispersing structural support, for instance, across the upper and lower surfaces of the radially extending flange 18. A secure metal spring seat 14 with improved structural support can be very desirable in a number of applications. It should be noted, however, the metal spring seat 14 is not limited to the embodiment shown and may take on any number of alternate configurations.

Figure 3:
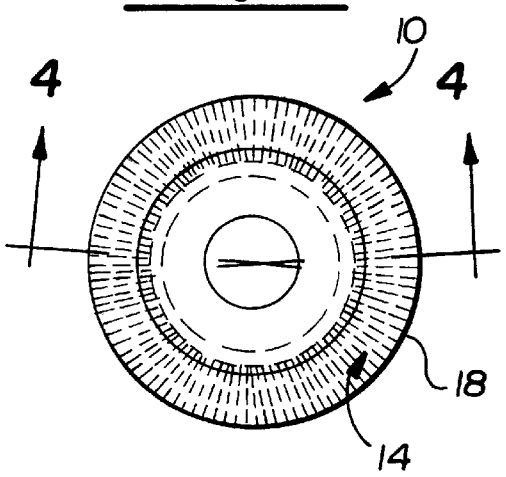
FIG. 3 is a top plan view of the embodiment of the valve seal body shown in FIG. 1.
Figure 4:
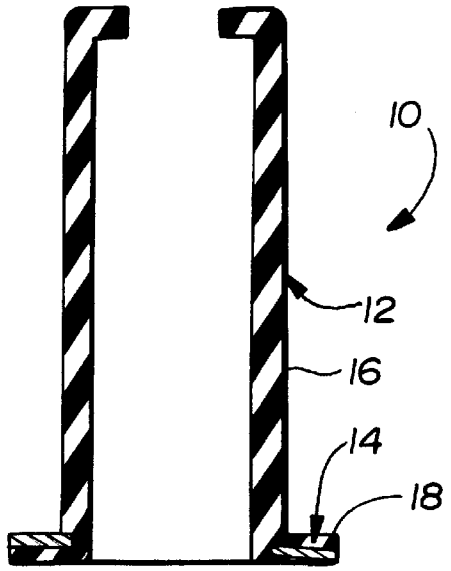
FIG. 4 is a section view of the embodiment of the valve seal body shown in FIG. 1 taken along the lines A—A of FIG. 3.

FIG. 3 shows a top plan view of the preferred embodiment disclosed in FIG. 1 and FIG. 4 depicts a section view of the same embodiment taken along lines A—A of FIG. 3. As illustrated by these views, the metal spring seat 14 is preferably substantially encapsulated with the valve seal body 12. More preferably, the spring seat 14 is substantially or entirely encapstulated within the radially extending flange 18. Moreover, by substantially encapsulating the spring seat 14, the position of the seat 14 can be better retained during assembly, thereby facilitating proper and efficient installation.

Figure 5:
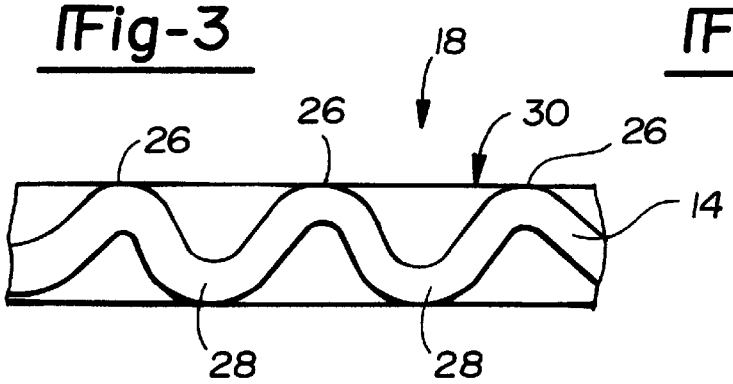
FIG. 5 is a section view of a portion of a radially extending flange wherein the metal spring seat is substantially encapsulated therein.

As illustrated in the partial section view shown in FIG. 5, the heat-resilient plastic material of the valve seal retainer 12 is interspersed within the plurality of alternating top portions 26 and bottom portions 28 of the metal spring seat 14. To make better use of the material properties and have the metal spring seat 14 bear much of the impact from the valve spring (not shown), the seat 14 is typically disposed so that the top portions 26, are substantially coplanar with the upper surface 30 of the radially extending flange 18. When the valve seal body 10 is configured in this manner, the top portions 26 of the metal spring seat will either be in close proximity or direct contact with the valve spring (not shown). Conversely, the bottom portions 28 of the spring seat 14 may or may not be fully encapsulated by heat-resilient plastic material.

Following a preferred procedure for construction, the metal spring seat 14 of the type described in this invention is first provided. The spring seat is subsequently secured at a specific position within a mold cavity having a desired configuration. In this manner, the metal spring seat 14 can be selectively positioned to improve the functioning thereof. The remainder of the valve seal body 10 is then formed around the metal spring seat 14 using any conventional molding process. Some of the more commonly used molding processing techniques for such applications includes injection and compression molding. Thereafter, the resulting valve seal body is allowed to cool for a sufficient amount of time before being placed into use.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications will come within the teachings of this invention and that such modifications are within its spirit and the scope as defined by the claims.

What is claimed is:

1. A valve seal body suitable for an internal combustion engine, comprising:

a valve seal retainer with a lower surface, the retainer including a cylindrical body which defines an inner cylindrical passageway and a radially extending flange substantially adjacent to the lower surface of the valve seal retainer, and a metal spring seat, which is substantially encapsulated within the flange of the valve seal retainer.

2. The valve seal body of claim 1, wherein the valve seal retainer is comprised of heat-resilient plastic material.

3. The valve seal body of claim 2, wherein the valve seal retainer is fabricated from a high temperature polyester elastomer.

4. The valve seal body of claim 3, wherein the high temperature polyester elastomer includes block copolymers of short chain diol terephthalate and long chain copolymers.

5. The valve seal body of claim 1, wherein the valve seal retainer is generally of a top hat configuration.

6. The valve seal body of claim 1, wherein the metal spring seat is substantially encapsulated within the radially extending flange.

7. The valve seal body of claim 1, wherein the metal spring seat is entirely encapsulated within the radially extending flange.

8. The valve seal of body claim 1, wherein the metal spring seat includes a metal washer.

9. The valve seal of body claim 8, wherein the metal washer is comprised of steel.

10. The valve seal of body claim 8, wherein the metal washer is corrugated.

11. The valve seal of body claim 1, wherein the metal spring seat is designed to withstand the temperature and pressure in a combustion engine and additionally provide a substantially vertical spring action effect.

12. A valve seal body suitable for an internal combustion engine, comprising:

a valve seal retainer with a lower surface, the retainer including a cylindrical body that defines an inner cylindrical passageway and a radially extending flange; and a metal spring seat including a corrugated metal washer having a plurality of alternating top and bottom portions, wherein the metal spring seat is substantially encapsulated within the flange of the valve seal retainer and the alternating lower portions of the metal washer are substantially adjacent to the lower surface of the valve seal retainer.

13. The valve seal body of claim 12, wherein the metal spring seat is entirely encapsulated within the valve seal retainer.

14. The valve seal body of claim 12, wherein the bottom portions of the metal washer are substantially planar with the lower surface of the valve seal retainer.

15. A method for making a valve seal body suitable for an internal combustion engine, comprising:

providing a metal spring seat;

providing a mold having a mold cavity of a desired configuration;

securing the metal spring seat within the mold cavity at a given location; and molding a heat-resilient plastic material around the metal spring seat and forming a valve seal retainer with a lower surface and a radially extending flange substantially adjacent to the lower surface substantially encapsulating the metal spring, seat within the flange of the valve seal retainer.

16. The method of claim 15, wherein the metal spring seat is a steel metal washer.

17. The method of claim 15, wherein the metal spring seat is corrugated.

18. The method of claim 15, wherein the method of molding is selected from the process group consisting of injection molding and compression molding.

19. The method of claim 15, wherein the mold cavity is formed by closing a pair of mold halves.

20. The method of claim 19, wherein the pair of mold halves forming the cavity are secured prior to molding.

* * * * *

UNITED STATES PATENT AND TRADEMARK OFFICE

CERTIFICATE OF CORRECTION

PATENT NO : 6,148,783

DATED : November 21, 2000

INVENTOR(S) : Eric Hesher, et al.

It is certified that error appears in the above-identified patent and that said Letters Patent are hereby corrected as shown below:

Col. 6, line 9
replace "surface substantially"
with --surface, substantially--.

Col. 6, line 10
replace "spring, seat"
with --spring seat--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*